US005415701A

United States Patent [19]

Nittel et al.

[11] Patent Number: 5,415,701

[45] Date of Patent: May 16, 1995

[54] PROCESS FOR FACILITATING COLD-WORKING OPERATIONS

[75] Inventors: Klaus-Dieter Nittel; Karl-Heinz Zander, both of Frankfurt am Main, Germany

[73] Assignee: Metallgesellschaft Aktiengesellschaft, Frankfurt am Main, Germany

[21] Appl. No.: 204,984

[22] Filed: Mar. 2, 1994

[30] Foreign Application Priority Data

Mar. 2, 1993 [DE] Germany ..... 43 06 446.9

[51] Int. Cl.[6] ..... C23C 22/14

[52] U.S. Cl. ..... 148/246; 148/262

[58] Field of Search ..... 148/262, 246

[56] References Cited

U.S. PATENT DOCUMENTS 5,221,370 6/1993 Jo ..... 148/262

FOREIGN PATENT DOCUMENTS 0045110 2/1982 European Pat. Off. .
0304108 2/1989 European Pat. Off. .
0403241 12/1990 European Pat. Off. .
0414301 2/1991 European Pat. Off. .
2389683 12/1978 France .
1214607 12/1970 United Kingdom .
9104354 4/1991 WIPO .

*Primary Examiner*—Sam Silverberg
*Attorney, Agent, or Firm*—Michael J. Striker

[57] ABSTRACT

In a process for facilitating non-cutting cold working of ferrous materials by application of a phosphate coating, ferrous materials are dipped into a phosphating solution which is free of elements of group VIB of the periodic table which consists of Cr, Mo and W, of nitrogen compounds and preferably also free of nickel and contains 5 to 20 g/l zinc
1 to 15 g/l magnesium
10 to 26 g/l phosphate calculated as $P_2O_5$
1 to 15 g/l fluoroborate calculated as $BF_4$
1 to 7 g/l chlorate calculated as $ClO_3$ and in which the weight ratio of $Zn:Mg:BF_4$ is adjusted to from 1:0.15:0.15 to 1:1:1.

11 Claims, No Drawings

PROCESS FOR FACILITATING COLD-WORKING OPERATIONS

BACKGROUND OF THE INVENTION

The present invention relates to a process for facilitating non-cutting cold working of a ferrous material by an application of a phosphate coating by dipping in an aqueous acid phosphating solution, which contains zinc ions, Mg ions and phosphate ions as well as oxidizing agents and is virtually free of Fe(II) ions.

Phosphate coatings are usually applied to metal surfaces to improve their resistance to corrosion and to improve the adhesion of the subsequently applied paint. Phosphate coatings serve also to facilitate the non-cutting cold-working operations and in that case act themselves as a "lubricant" which avoids a seizing or welding of the workpiece material and the tool or they act to bind a subsequently applied lubricant so firmly that it virtually will not be removed by the shaping operation. Particularly the last-mentioned property is of special significance, because only the combination of the phosphate coating and the lubricant permits a repeated strong cold working, possibly without a new intermediate treatment with a lubricant.

Numerous processes for facilitating cold-working operations by an application of phosphate coatings are known. They may belong either to the category of the "layer-forming" processes or to the category of the "non-layer-forming" processes, although the latter are much less significant.

In "layer-forming" processes, phosphate coatings are formed by phosphating solutions which, in addition to the phosphate ions, contain also a major part of the cations used to form the coating. On the contrary, in the so-called "non-layer-forming" processes the cations of the phosphate coating usually come from the metal which is being treated and the phosphating solution usually supplies only the phosphate ions.

For instance, EP-A-45110 describes a process of forming phosphate coatings on iron or steel surfaces by a dipping or flooding process, in which phosphating solutions are used which contain at least 0.3%, by weight Zn, at least 0.3%. by weight $PO_4$, and at least 0.75% by weight $NO_3$ or an equivalent accelerator which does not oxidize iron(II). The $Zn:PO_4$ weight ratio should exceed 0.8 and an iron(II) content of 0.05 to 1% by weight should be adjusted. The solutions described in this reference may contain calcium, which may be replaced entirely or in part by magnesium, and can be used to form phosphate coatings, i.a., in preparation for cold-working operations.

The process outlined hereinbefore is carried out "on the iron side". Any advantage whatever which might be afforded by the particularly emphasized calcium content of the phosphating solution has not been mentioned.

EP-A-403 241 describes a process for forming zinc phosphate coatings on metal surfaces by means of aqueous zinc phosphate solutions, which contain 2 to 20 g/l zinc, 5 to 40 g/l phosphate, and silicotungstic acid and/or silicotungstate in a concentration of 0.005 to 20 g/l (calculated as W). The phosphating solutions may contain nitrite, nitrobenzene sulfate, hydrogen peroxide, nitrate, and chlorate as an accelerator. The phosphating solution may additionally contain nickel, cobalt, calcium, and manganese as well as 0.5 to 10 g/l magnesium. The process can be used, inter alia, to prepare metals for cold-working operations.

A disadvantage of that process resides in that the tungsten contained in the phosphating solution will necessarily enter subsequently used rinsing baths so that problems arise in connection with the treatment of waste water.

Finally, the phosphating process disclosed in EP-A-414 301 uses phosphating solutions which contain 0.4 to 30 g/l zinc, 4 to 30 g/l $P_2O_5$, 5 to 50 g/l $NO_3$, up to 10 g/l Fe(II), and up to 0.3 g/l Fe(III). The solutions may also contain up to 10 g/l magnesium, inter alia, and are replenished in a specific manner and operated with a specific oxidizing additive so that the real object of that process, to permit a processing substantially without a formation of waste water, can be achieved. The magnesium content of the phosphating solutions or their calcium content, which is allegedly equivalent, affords the advantage that the coatings, which contain mixed phosphates have a higher resistance to alkali and, for this reason, are particularly suitable as primers for paints.

The phosphating processes discussed hereinbefore and most other phosphating processes have in common that they use nitrate, nitrite and/or organic nitro compounds, such as nitrobenzene sulfonate, as an accelerator. But such compounds give rise to problems in the treatment of rinse washings and waste water, because they can be removed and decomposed only with difficulty.

SUMMARY OF THE INVENTION

It is an object of the invention to facilitate the cold working of ferrous materials by application of a phosphate coating in a process in which the disadvantages of the known processes are avoided and which in particular does not give rise to waste water problems and results in a formation of firmly adhering coatings in a thickness which is sufficient for cold-working operations and which is nevertheless comparatively simple.

According to the invention, the process of the kind described hereinbefore is carried out in accordance with the invention by applying a phosphating solution to a ferrous material by dipping the ferrous material into the solution. The phosphating solution used in the method according to the invention is free of elements of group VIB of the periodic system consisting of Cr, Mo and W, free of nitrogen compounds and contains 5 to 20 g/l zinc
1 to 15 g/l magnesium
10 to 26 g/l phosphate (calculated as $P_2O_5$)
1 to 15 g/l fluoroborate (calculated as $BF_4$)
1 to 7 g/l chlorate (calculated as $ClO_3$)

and in which a weight ratio of $Zn:Mg:BF_4$ ranges from 0.15:0.15 to 1:1:1.

The omission of nitrogen compounds permits the expenditure due to processing of waste water from rinsing and spent phosphating bath liquid to be substantially decreased. In the process in accordance with the invention it has been recognized that this omission is possible if the active constituents and their concentrations are properly selected and the ratio of $Zn/Mg/BF_4$ in the phosphating solution is adjusted with special care. The formation of phosphate coatings which permit a satisfactory cold working is ensured only under these conditions. Owing to the crystal structure of the resulting phosphate coating, the otherwise usual activating treatment, e.g., with activating agents based on titanium phosphate, before the phosphating treatment may be omitted. This does not mean that it is necessary to omit an activating treatment. The additional grain refining which is achieved is much smaller than in the conventional methods.

For this reason it is a preferred feature of the invention that to form the phosphate coating the ferrous material is dipped into a phosphating solution which contains 6 to 17 g/l zinc
2 to 5 g/l magnesium
13 to 20 g/l phosphate (calculated as $P_2O_5$)
2 to 5 g/l fluoroborate (calculated as $BF_4$)
2 to 4 g/l chlorate (calculated as $ClO_3$)

In a preferred embodiment of the invention the weight ratio of Zn:Mg:$BF_4$ is 1:0.23:0.23 to 1:0.46:0.46. This ratio provides the advantage that the consumption of chemicals is very low and a particularly good phosphate layer is formed.

It is also advantageous to dip the ferrous materials into a phosphating solution which contains 5 to 40 g/l and preferably 10 to 30 g/l sulfate. In principle the phosphating solution may be adjusted to be electrically neutral by an addition of chlorides and acetates. They are less desirable, because the treated workpieces are susceptible to corrosion (chloride) to some extent or because relatively high costs are involved (acetate). Besides, the addition of sulfate provides the advantage that it exerts a favorable influence on the crystal structure of the resulting phosphate layer, since the absorption capacity for and the anchoring of the usually applied lubricant is improved.

According to a further desirable feature of the invention the acid ratio of the phosphating solution to be employed should be from 0.1 to 0.4. The acid ratio is the ratio of "free acid" calculated as $P_2O_5$—to the so-called "Fischer total acid", i.e., the total amount of $P_2O_5$ defined by the consumption of 0.1N NaOH in milliliters during the titration of a bath sample of 10 ml (see W. Rausch "Die Phosphatierung von Metallen", 2nd edition, Eugen G. Leuze Verlag D Saalgau 1988, pages 299 to 304).

In a further desirable embodiment of the invention the ferrous materials are dipped into a phosphating solution which is free of nickel.

The absence of nickel provides the advantage that the treatment of the wash water from rinsing or the rinse water or of the spent phosphating bath before the discharge into the sewer is simplified and the sludge formed as a result of the treatment will be less problematic. From the aspect of working place hygiene the absence of nickel is of advantage in the phosphating plant and in the means for cold working (raising of dust).

The temperature at which the phosphating solution is applied can freely be selected within wide limits. According to a further preferred feature of the invention the ferrous materials are dipped into a phosphating solution which has been adjusted to a temperature from 50° to 70° C. Optimum conditions regarding the rate at which the layer is formed and the thermal economy are attained in that case. At the temperatures mentioned above the treatment usually takes between 3 and 15 minutes.

The phosphating solution may be formulated as such from the individual components but it will be particularly desirable to formulate it from a concentrate. In both cases the cations are introduced, e.g., as a metal, oxide, carbonate, sulfate, phosphate and, if desired, also as a chlorate. The anodic component may be supplied as alkali phosphate and/or phosphoric acid.

The phosphating solutions used in the process in accordance with the invention may contain, in addition to the components mentioned hereinbefore, additional additives known per se, which in most cases are present only in minor amounts. These additives include, e.g., copper, manganese, calcium and sludge-conditioning agents.

The phosphating solution is applied by dipping, and also flooding.

The process in accordance with the invention can be adopted to form phosphate coating layers having a weight of about 5 to 15 g/m$^2$. This permits an adaptation of the weight of the layer to the severity of the intended cold-working operation and to the size of the workpiece and the like. In the selection of the weight of the layer it should also be taken into account whether or not a lubricant is subsequently be applied.

Before the phosphating treatment the workpieces are pretreated in the conventional manner, e.g., by cleaning, pickling, rinsing and optionally by activating. For an aftertreatment, a lubricant which is conventional for the cold-working operations is usually applied. This can be effected immediately after the coating operation or after an interstage rinse. Alternatively the lubricant may be applied immediately before the shaping operation and, if desired, between the shaping steps. If the lubricant is applied in order to form zinc soaps, the phosphate coating must have a moisture content which is sufficient for the reaction.

The lubricants which are applied may consist of soaps, oils and other substances for assisting the cold-working operations or of emulsions of fatty acids or soaps, particularly with 8 to 18 carbon atoms in the acid anion. With a view to the above-mentioned reaction with the cation of the phosphate coating it will be particularly desirable to use sodium soaps and/or potassium soaps, especially stearates.

The sequence of steps which is preferred in the practice of the invention consists of 1. cleaning (optionally with an additional pickling);
2. rinsing with hot water;
3. treating with the phosphating solution;
4. rinsing with cold water;
5. rinsing with a weakly alkaline solution;
6 contacting with a surplus of a lubricant based on sodium stearate;
7. drying.

The pretreatment may optionally be supplemented by an activating step. In that case the ferrous material may be subjected to cold working immediately or after an intermediate storage.

The invention will be explained more in detail and by the following examples.

EXAMPLES

Example 1

A wire of C45 grade steel, which was 5.5. mm in diameter, was treated by the following procedure:

1. cleaning by dipping into an alkaline cleaner having a concentration of 5 g/l at a temperature of 60° C.; 2. rinsing with tap water at ambient temperature; 3. pickling in hydrochloric acid having a concentration of 17% by weight at 40° C.; 4. rinsing with tap water at ambient temperature; 5. phosphating in a phosphating solution, which is at 60° C. and contains 15 g/l Zn
4.5 g/l Mg
15 g/l phosphate (calculated as $P_2O_5$)
4.5 g/l fluoroborate (calculated as $BF_4$)
3.0 g/l chlorate (calculated as $ClO_3$)
29.2 g/l sulfate (calculated as $SO_4$) by dipping for 8 minutes (acid ratio 0.28 to 0.38), weight of layer 10 g/m$^2$;

6. rinsing with tap water at ambient temperature;
7. applying a borax solution at 80° C.
8. drying up the borax solution.

The thus pretreated steel wires were subsequently drawn by different methods in different ways:

a) to a final diameter of 1.2 mm in 12 passes at a drawing speed of 20 m/sec;
b) to a final diameter of 2.82 mm in 5 passes at a drawing speed of 5 m/sec;
c) to a final diameter of 1.8 mm in 8 passes at a drawing speed of 8 m/sec.

In all cases the shaping, inclusive of the last pass, was satisfactory. A closed phosphate layer or coating was still present, even after the last pass.

Example 2

Tubes made of grade ST35 and grade St52 steels were treated by the following procedure:

1. pickling in hydrochloric acid having a concentration of 17 % by weight at 40° C.;
2. rinsing with tap water at ambient temperature;
3. activating with an activating agent based on titanium phosphate (1 g/l) at room temperature;
4. phosphating in a phosphating solution at 60° C., which contained 7.5 g/l Zn
2.25 g/l Mg
15 g/l phosphate (calculated as $P_2O_5$)
2.25 g/l fluoroborate (calculated as $BF_4$)
3.0 g/l chlorate (calculated as $ClO_3$)
12.1 g/l sulfate (calculated as $SO_4$) by dipping for 10 minutes (acid ratio 0.28 to 0.38) weight of layer 7 g/m$^2$);

5. rinsing with tap water at ambient temperature;
6. applying a solution of sodium stearate;
7. drying up the soap solution.

The tubes which had been pretreated as stated hereinbefore were then profiled by a single drawing pass.

The tubes made of grade ST35 steel were drawn at 60 m/min and the tubes made of grade ST52 steel at 30 m/min.

In all cases the pass was satisfactory and a closed phosphate layer was still present after the shaping operation.

It will be understood that each of the elements described above, or two or more together, may also find a useful application in other types of constructions differing from the types described above.

While the invention has been illustrated and described as embodied in a process for facilitating cold-working operations, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

What is claimed

1. A process for facilitating non-cutting cold working of a ferrous material, said process comprising the step of applying to said ferrous material an aqueous acid phosphating solution by dipping to form a phosphate coating on said ferrous material, wherein said aqueous acid phosphating solution contains oxidizing agents, is virtually free of Fe(II) ions, is free of elements of group VIB of the periodic system, said group VIB consisting of Cr, Mo and W, is free of nitrogen compounds and contains 5 to 20 g/l zinc
1 to 15 g/l magnesium
10 to 26 g/l phosphate calculated as $P_2O_5$
1 to 15 g/l fluoroborate calculated as $BF_4$
1 to 7 g/l chlorate calculated as $ClO_3$ and in which a weight ratio of Zn:Mg:$BF_4$ is from 1:0.15:0.15 to 1:1:1.

2. A process as defined in claim 1, wherein said phosphating solution contains 6 to 17 g/l said zinc
1 to 5 g/l said magnesium
13 to 20 g/l said phosphate calculated as $P_2O_5$
2 to 5 g/l said fluoroborate calculated as $BF_4$
2 to 4 g/l said chlorate calculated as $ClO_3$.

3. A process as defined in claim 1, wherein the weight ratio of Zn:Mg:$BF_4$ in said solution ranges from 1:0.23:0.23 to 1:0.46:0.46.

4. A process as defined in claim 1, wherein said phosphating solution contains 5 to 40 g/l of sulfate calculated as $SO_4$.

5. A process as defined in claim 4, wherein said phosphating solution contains 10 to 30 g/l of said sulfate calculated as $SO_4$.

6. A process as defined in claim 1, wherein said phosphating solution has an acid ratio of from 0.1 to 0.4.

7. A process as defined in claim 1, wherein said phosphating solution is free of nickel.

8. A process as defined in claim 1, wherein said phosphating solution which has a temperature from 50° to 70° C. during said applying.

9. A process as defined in claim 2, wherein said ferrous material is dipped into said phosphating solution for 3 to 15 minutes during said dipping.

10. A process as defined in claim 1, further comprising, prior to applying said phosphating solution, cleaning said ferrous material and pickling said ferrous material with a 17% by weight hydrochloric acid solution.

11. A process as defined in claim 10, further comprising, after applying said phosphating solution, rinsing said ferrous material with cold water: after rinsing with cold water, rinsing said ferrous material with a weakly alkaline solution; contacting said ferrous material with a solution of sodium stearate as a lubricant and after said contacting drying.

* * * * *